US005247227A

United States Patent [19]

Park

[11] Patent Number: 5,247,227

[45] Date of Patent: Sep. 21, 1993

[54] PLASMA DISPLAY PANEL

[75] Inventor: Nam-sin Park, Kyunggi, Rep. of Korea

[73] Assignee: Samsung Electron Devices Co., Ltd., Kyunggi, Rep. of Korea

[21] Appl. No.: 783,879

[22] Filed: Oct. 29, 1991

[30] Foreign Application Priority Data

Oct. 31, 1990 [KR] Rep. of Korea ..... 90-17595

[51] Int. Cl.[5] ..... H01J 61/067; H01J 17/49

[52] U.S. Cl. ..... 313/584; 313/586

[58] Field of Search ..... 313/584, 585, 586

[56] References Cited

U.S. PATENT DOCUMENTS 3,885,195 5/1975 Amano ..... 313/584 X 4,516,053 5/1985 Amano ..... 313/584

FOREIGN PATENT DOCUMENTS 180043 9/1985 Japan ..... 313/586

*Primary Examiner*—Palmer C. Demeo

*Attorney, Agent, or Firm*—Leydig, Voit & Mayer

[57] ABSTRACT

A plasma display device is disclosed having a number of anode pairs disposed on a front panel. Barrier ribs are disposed on the front panel spaced at predetermined intervals. Each anode pair includes odd and even anodes. The odd and even anodes of a given anode pair are partially buried in a corresponding rib.

6 Claims, 2 Drawing Sheets

PLASMA DISPLAY PANEL

BACKGROUND OF THE INVENTION

The present invention relates to a plasma display device and more particularly to a direct current (DC) plasma display panel.

Generally, a DC plasma display panel (hereinafter referred to as a PDP) is installed in such a manner that cathodes and anodes each supplied with a high DC voltage, are exposed to a discharge gas filling a sealed space. The cathodes and anodes are arranged in a stripped pattern, and cross each other, forming a so-called X-Y matrix.

An example of a conventional DC-type PDP is shown in FIG. 1. In this PDP, anodes A and cathodes K are arranged in an X-Y matrix on the respective inner surfaces of a front plate 10 and a rear plate 20 spaced apart from each other at predetermined intervals by barrier ribs B arranged in equal intervals. The anodes A are arranged in the same direction as the barrier ribs B, in which one edge is buried halfway into the lower portion of the barrier rib B, and only its opposite edge being partially exposed.

In the PDP having the aforementioned structure, a discharge light generated between an anode and a cathode can be emitted without being obstructed by the anode. It also has an advantage in that the anode thickness is greater than that of other types of PDPs in which the discharged light needs to radiate through the anode, enhancing the efficiency of discharge, lessening the unevenness of the brightness depending on the locations and thereby greatly reducing the number of interior products. However, since anodes are biasedly arranged adjacent to one side of each discharge space in the conventional PDP, discharge light from the discharge space is partially shielded by one edge of each anode. Such partial blocking of the discharge light by the anode results in biased path of discharge light to render visual difference from varying viewing angles. As for the structure, since the anode is buried into only one side of a barrier rib, those barrier ribs formed through a thick layer forming process tilt to one side, thereby weakening the structure's strength.

SUMMARY OF THE INVENTION

It is an object of the present invention to provide a PDP whose structure and fabrication method thereof is improved, thereby alleviating the above mentioned problems.

To accomplish the object of the present invention a new PDP comprises:

front and rear plates spaced apart by a predetermined distance from each other;

a plurality of barrier ribs arranged in parallel between the front and rear plates;

a plurality of cathodes arranged perpendicular to the barrier ribs on the rear plate;

a plurality of anodes arranged perpendicular to the cathodes on the front plate in such a manner that every pair of opposite anodes are arranged centering around every other barrier rib and one edge of each anode is buried in the barrier rib.

To achieve the object of the present invention, a fabrication method of a plasma display panel comprising two substrates, a plurality of metal thick layer anodes and cathodes arranged in the form of an X-Y matrix on the respective inner surfaces of the substrates, and barrier ribs for preventing cross-talk between pixels, comprises the steps of:

forming odd anodes on the front plate at intervals twice the normal interval;

forming base layers of the odd and even barrier ribs on the front plate at the normal interval, having one edge of the base layer of each odd barrier rib overlapped with the corresponding odd anode;

forming even anodes on the front plate at intervals twice the normal intervals oppositely to the respective odd anodes, having one edge of each even anode overlapped with the corresponding base layer of each odd barrier rib; and forming multiple upper layers on the base layers of the odd and even barrier ribs to complete the whole barrier ribs.

BRIEF DESCRIPTION OF THE DRAWINGS

The above objects and other advantages of the present invention will become more apparent by describing the preferred embodiment of the present invention with reference to the attached drawings, in which.

DETAILED DESCRIPTION OF THE INVENTION

Figure 1:
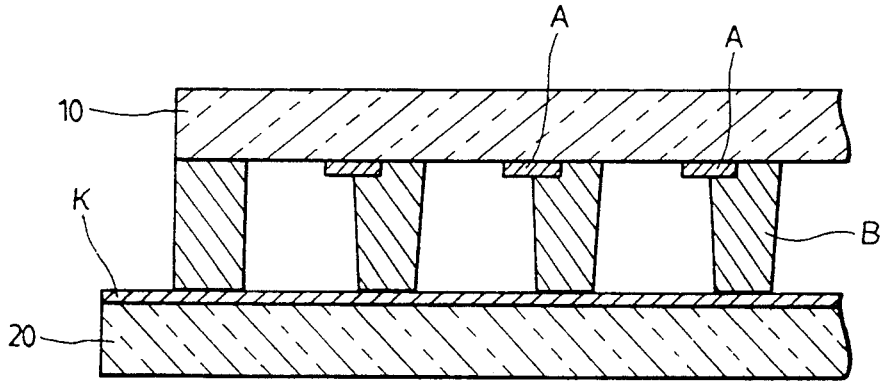
FIG. 1 (PRIOR ART)
FIG. 1 is a schematic cross-sectional view of the conventional plasma display device.
Figure 2:
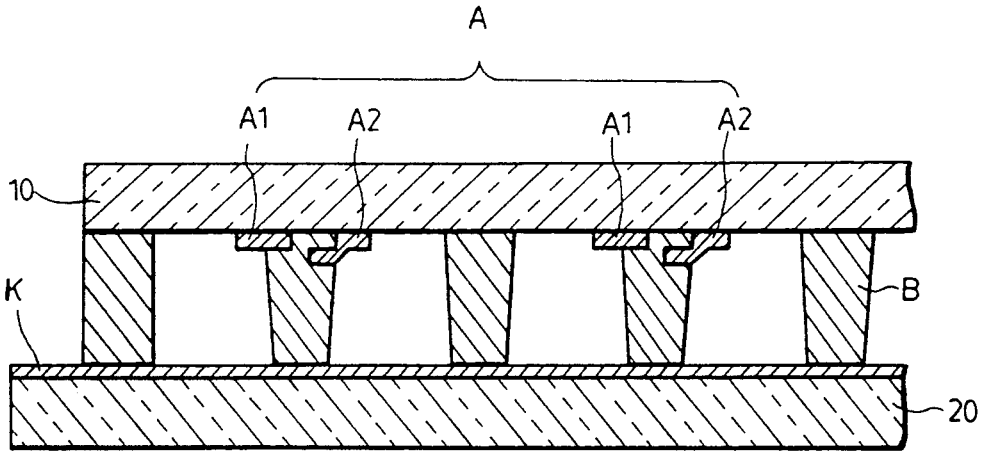
FIG. 2 is a schematic cross-sectional view of the plasma display device according to the present invention.

The PDP of the present invention has the structure shown in FIG. 2.

A front plate 10 and a rear plate 20 oppose each other with a proper interval, and metal thick layer cathodes K and metal thick layer anode group A arranged in stripes form an X-Y matrix on the respective inner surfaces of the two plates. A barrier rib B arranged in the same direction as that of the anode A is provided on the front plate 10. The anodes group A is separated into a group of odd anode A1 and a group of even anodes A2, in which the juxtaposed edges of the odd anode A1 and the even anode A2, are partially buried into every other barrier rib. Here, the buried edge of the even anodes is separated from the front plate 10, unlike that of the odd anode A1.

As described above, the present PDP is characterized in that a pair of opposite anodes are buried halfway into the lower portion of every alternate barrier rib. But it is driven in similar way to that for the conventional display panel in which one anode and the corresponding cathode are selected and supplied with a predetermined voltage to generate gas discharge at the intersection of cathode and the exposed edge of anode which is not buried in the barrier rib.

The following steps form both an anode group A composed of odd and even anode A1 and A2, and a barrier rib group B composed of odd and even barrier ribs B1 and B2, which make up the characteristic feature of the process for manufacturing the present PDP having the aforementioned structure.

Figure 3A:
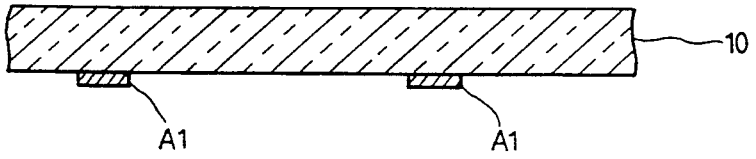
FIGS. 3A through 3D are cross-sectional views showing the sequential steps of forming a barrier rib and an anode on the front plate according to the fabrication method of the present invention.

As shown in FIG. 3A, the odd anode A1 is formed on the front plate 10 at intervals twice the usual interval, by a screen printing method using a nickel paste.

Figure 3B:
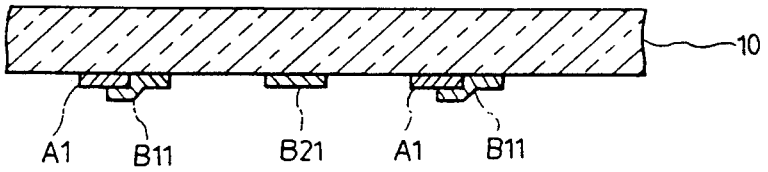

Base layers B11 and B21 of the barrier rib group B are formed at the usual intervals on the front plate 10, in which, as shown in FIG. 3B, the base layer B11 overlaps one edge of each odd anode A1. If necessary, the base layer can be of multiple layers.

Figure 3C:
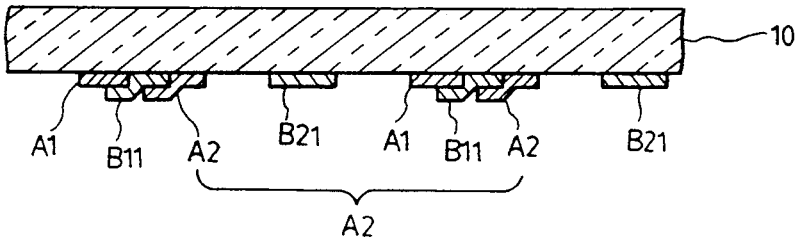

Then, the even anode A2 of the anode group A is formed on the front plate also at doubly spaced intervals and by the same screen printing method, but offset from the odd anode. As shown in FIG. 3C, one edge of each even anode A2 partially overlaps the base layer B11, which, as previously mentioned, has overlapped the adjacent edge of the odd anode A1.

Figure 3D:
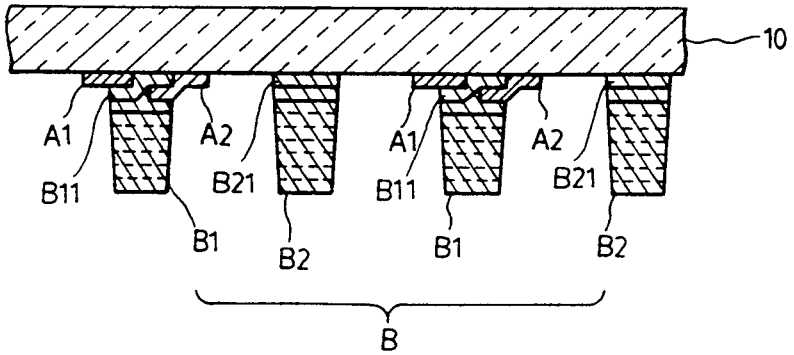

Finally, as shown in FIG. 3D, the barrier rib B1 and B2 are completed by laminating their remaining layers over the base layers B11 and B21 several times.

The front plate 10 provided with each element through the aforementioned processes is combined with the rear plate 20 which is provided with cathodes K, to form one PDP by a subsequent fabrication process.

In the PDP manufactured by the fabrication method of the present invention as described above, both elements of anode group A (A1 and A2) are not formed at one time but manufactured through two steps, so that there is no probability of shorts resulting between adjacent anodes, and greatly improving productivity. Since in this structure, adjacent anodes have a barrier rib at their center into which their edges are partially buried, the barrier ribs are not tilted to one side as in a conversational PDP one. Also, the proceeding direction of the emitting light of each pixel is alternately diverted away from its anode, which reduces the variation in luminance due to a change in viewing angle.

Although the embodiment of the present invention is limited to a very simple structure among various complex plasma display panels applicable to the present invention, and the preferred application is for a product having high and even luminance, the specifically preferred application is for a very complex, and, particularly, a high density image display device. It is inevitable that without deviating from the basic technical idea pursued by the present invention, many PDP fabrication methods are within the scope of the present invention as defined in the appended claims.

What is claimed is:

1. A plasma display panel comprising:

front and rear plates spaced part by a predetermined distance from each other, at least one of said front and rear plates being transparent;

a plurality of elongate barrier ribs arranged parallel to each other between the front and rear plates, a plurality of elongate cathodes arranged perpendicular to the barrier ribs on the rear plate, such that a discharge space is formed between said front plate, said cathodes and adjacent barrier ribs, the discharge space being filled with gas;

a plurality of elongate anode pairs arranged perpendicular to the cathodes on the front plate in such a manner that every other one of said plurality of elongate barrier ribs is sandwiched between one of said plurality of anode pairs.

2. A plasma display panel according to claim 1 wherein each anode pair consists of an odd anode and an even anode, and a portion of the barrier rib is sandwiched between an edge of the even anode and pierces the barrier rib and the front plate.

3. A plasma display panel comprising:

front and rear plates spaced apart by a predetermined distance from each other, said front and rear plates being transparent;

a plurality of elongate barrier ribs disposed between the front and rear plates;

a plurality of elongate cathodes disposed on the rear plate, such that a discharge space is formed between said front plate, said cathode and adjacent barrier ribs, the discharge space being filled with gas;

a plurality of elongate anode pairs arranged such that a barrier rib is sandwiched between each anode pair and an edge of the even and odd anodes of each anode pair pierces the barrier rib such that a portion of the barrier rib is sandwiched between the edge of the even anode that pierces the barrier rib and said front plate.

4. A plasma display panel according to claim 3 wherein said barrier ribs are evenly spaced by a predetermined distance.

5. A plasma display panel according to claim 3 wherein every other barrier rib is sandwiched between an anode pair.

6. A plasma display panel according to claim 5 wherein the edge of the odd anode that pierces the barrier rib is sandwiched between a portion of the barrier rib and the front plate.

* * * * *

UNITED STATES PATENT AND TRADEMARK OFFICE

CERTIFICATE OF CORRECTION

PATENT NO. : 5,247,227

DATED : September 21, 1993

INVENTOR(S) : Nam-sin Park

It is certified that error appears in the above-indentified patent and that said Letters Patent is hereby corrected as shown below:

Claim 1, column 4, line 8, change "formed" to --forced--.

Signed and Sealed this

Ninth Day of May, 1995

Bruce Lehman

*Attest:*

BRUCE LEHMAN

*Attesting Officer*

*Commissioner of Patents and Trademarks*